United States Patent [19]

Weitman

[11] Patent Number: 4,726,814

[45] Date of Patent: Feb. 23, 1988

[54] METHOD AND APPARATUS FOR SIMULTANEOUSLY RECOVERING HEAT AND REMOVING GASEOUS AND STICKY POLLUTANTS FROM A HEATED, POLLUTED GAS FLOW

[76] Inventor: Jacob Weitman, Tryffelstigen 8, S-611 63 Nyköping, Sweden

[21] Appl. No.: 34,155

[22] PCT Filed: Jun. 27, 1986

[86] PCT No.: PCT/SE86/00317

§ 371 Date: Feb. 18, 1987

§ 102(e) Date: Feb. 18, 1987

[87] PCT Pub. No.: WO87/00089

PCT Pub. Date: Jan. 15, 1987

[30] Foreign Application Priority Data

Jul. 1, 1985 [SE] Sweden ..... 85 03273

[51] Int. Cl.[4] ..... B03C 3/12; B03C 3/49

[52] U.S. Cl. ..... 55/11; 55/13; 55/121; 55/135; 55/138; 55/141; 55/151; 55/154

[58] Field of Search ..... 55/9, 11, 13, 117, 121, 55/135, 136, 138, 141, 151, 154

[56] References Cited

U.S. PATENT DOCUMENTS

| | | | |
|---|---|---|---|
| 1,204,906 | 11/1916 | Schmidt et al. | 55/11 |
| 2,615,530 | 10/1952 | Hodson et al. | 55/122 |
| 3,026,964 | 3/1962 | Penney | 55/138 X |
| 4,092,134 | 5/1978 | Kikuchi | 55/135 X |
| 4,431,434 | 2/1984 | Rinard et al. | 55/135 |

FOREIGN PATENT DOCUMENTS

| | | | |
|---|---|---|---|
| 2755059 | 6/1979 | Fed. Rep. of Germany | 55/135 |
| 215135 | 11/1941 | Switzerland | 55/135 |

*Primary Examiner*—Kathleen J. Prunner

*Attorney, Agent, or Firm*—Witherspoon & Hargest

[57] ABSTRACT

The gas flow is ionized by its being caused to pass an emission electrode means (2) so that ions are formed and the polluant particles are given an electric charge. The particles are deposited by electrostatic attraction onto a combined collector electrode/heat exchanger surface (6), there also being generated a new aerosol by the gas flow being cooled as it passes said collector/heat exchanger surface, pollutants in the gas phase condensing onto the ions and electrically charged particles serving as condensation cores simultaneously as heat is recovered from the gas flow. The apparatus includes a heat exchanger (1) of the tube type, having a plurality of emission electrode means (2, 3, 4) inserted between groups of heat exchanger pipes. The collector electrode/heat exchanger surfaces on the pipes can be cleaned by a cleaning means (5) during operation of the apparatus, and in some applications the emission electrode means can also be automatically cleaned.

8 Claims, 4 Drawing Figures

METHOD AND APPARATUS FOR SIMULTANEOUSLY RECOVERING HEAT AND REMOVING GASEOUS AND STICKY POLLUTANTS FROM A HEATED, POLLUTED GAS FLOW

The apparatus in accordance with the invention may be described schematically as a combined electrostatic dust collector and a condensation cooler/separator, where the apparatus not only performs the customary functions, such as separating particles and recovering heat from a gas flow, but also permits cleaning the gas flow from pollutants in the gas phase, such as toxic solvents.

The inventive apparatus is suitable for separating polluted exhaust air from industrial furnaces and ovens, tenters, PVC curing lines etc., as well as for cleaning air from flue gases, from fungi and bacteria in plants producing antibiotics and other medicaments, for removing oil mist in machinery and acid mist in chemical process plants, and in plants of the latter kind where low grade waste heat is to be recovered. Electrostatic dust collectors are known, and are used to separate particulate pollutants from a gas flow. In its simplest form, the electrostatic dust collector consists of a vertical tube containing a concentrically placed electrically conductive wire insulated from the tube and carrying a DC voltage in the order of magnitude of 10–100 kV. A corona discharge occurs in the immediate vicinity of the wire, and the particles suspended in the gas flow are charged by ions in the gas, whereon they move towards the wall of the tube, to deposit themselves thereon. Liquid particles combine into droplets, which depart at the bottom of the tube. Solid particles may be removed by mechanical vibration or by mechanical scrapers. The disadvantages with the known electrostatic dust collectors are that they only permit the removal of particles already present in particle form, preferably dry particles. When the filter has to be cleaned, it has to be taken out of service, and the particle collectors, usually plates, have to be washed and sprayed. A disadvantage with electrostatic filters is thus that they do not permit the separation of pollutants having particles that are sticky or viscous to an extent where they will not leave the filter. Another disadvantage is that the filter must be taken out of service when it is to be cleaned, thus causing plant downtime.

Neither can electrostatic filters be used for separating pollutants in the gas phase. At present, for this purpose, there are used instead either activated carbon filters or so-called wet scrubbing plants. Post combustion of the gas flow containing the pollutants in the gaseous phase is also an alternative. Activated carbon filters are expensive in operation, inter alia because the carbon must be changed or regenerated. Wet scrubbing plant cools the gas flow and degrades its heat content, thus making such plant uninteresting from the heat recovery aspect. Post combustion of the gas flow is to be condemned from the energy aspect, since there is an increase in waste heat. Post combustion moreover requires costly investment in combustion plant and chimneys.

The present invention has the object of providing a method and apparatus which, while obviating the disadvantages in the prior art described above, permit the recovery of heat and the removal of both sticky and gaseous pollutants from a heated gas flow. The salient features characterizing the invention will be seen from the accompanying claims. An embodiment of the invention will now be described in detail with reference to the accompanying drawings, on which:

Figure 1:
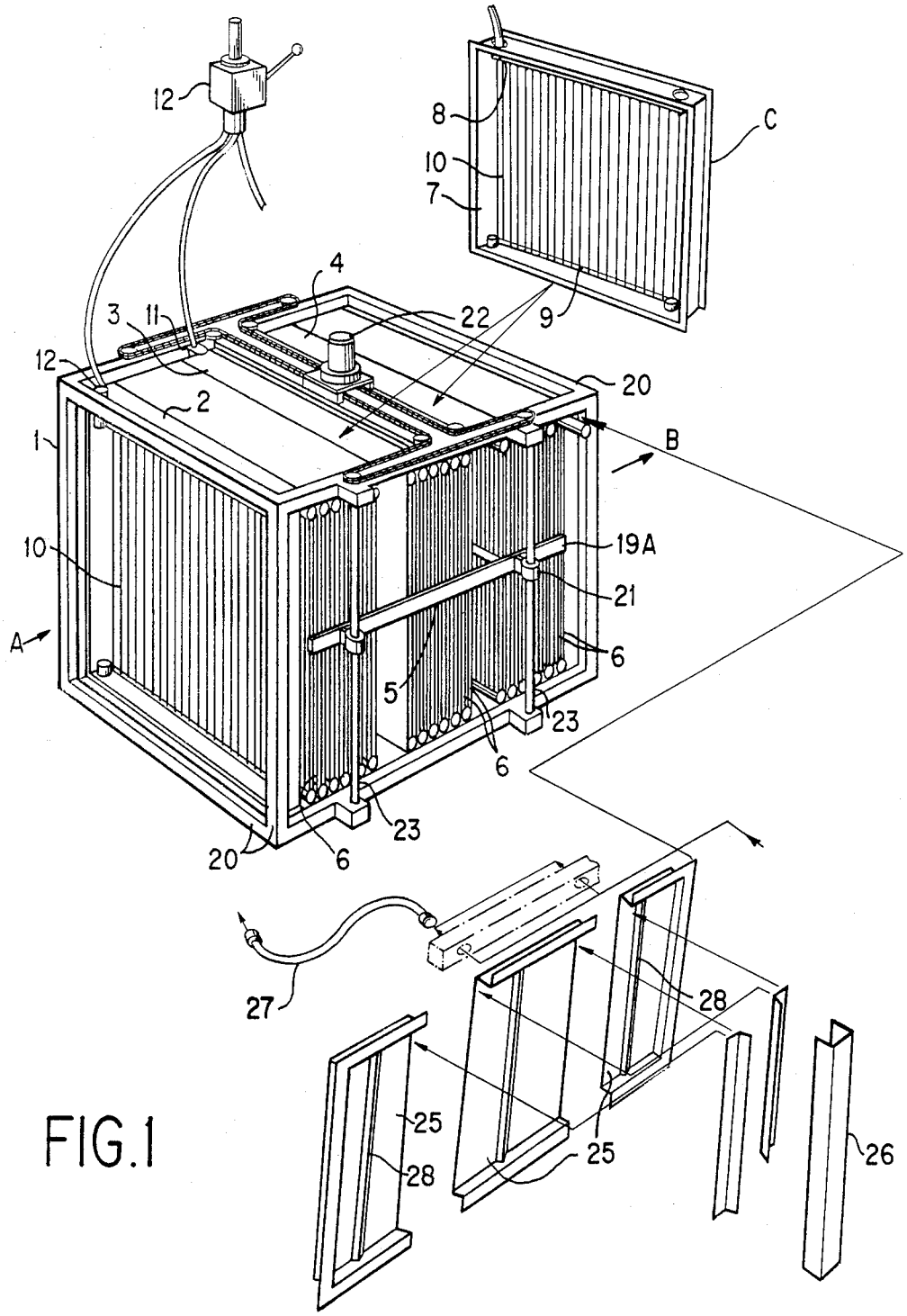
FIG. 1 is a perspective view of the inventive apparatus.

In a perspective view, FIG. 1 illustrates the apparatus in accordance with the invention in its main parts, which are a heat exchanger 1, and three emission electrode means 2, 3, 4 arranged consecutively inside the heat exchanger. The incoming, heated and polluted gas flow enters at one end surface of the heat exchanger, as illustrated by the arrow A, and departs via the opposite end surface, where the arrow B denotes the cleaned and cooled gas flow. The flow path through the heat exchanger 1 is defined by plates covering the top, bottom and side walls of the heat exchanger 1 in FIG. 1. Of these plates, those of one side wall are denoted by the numeral 25. A cleaning means 5 is intended for cleaning the schematically illustrated vertically upstanding tube 6 of the heat exchanger. The latter is of the general type described in the Swedish patent specification No. 80 06 390-2. Each emission electrode means is of the kind illustrated at C in FIG. 1. The means comprises a frame 7 made up from formed elements, There are electrically insulated battens 8, 9 mounted on the top and bottom elements, and extending between the battens there are electrically conductive wires 10. These are given a potential of between 10 to 100 kV via an electrical connection device 11, such as to cause a corona discharge in the immediate vicinity of the respective wire. The voltage to each emission electrode means 2–4 can be connected and disconnected with the aid of a switch 12, such that each emission electrode means, which is formed as a cassette, can be removed and replaced with a new one without needing to take the heat exchanger out of operation. In certain embodiments the means may be provided with automatic, mechanical scraping devices.

The emission electrodes are conventional corona discharge devices in a preferred embodiment of the invention.

Figure 2:
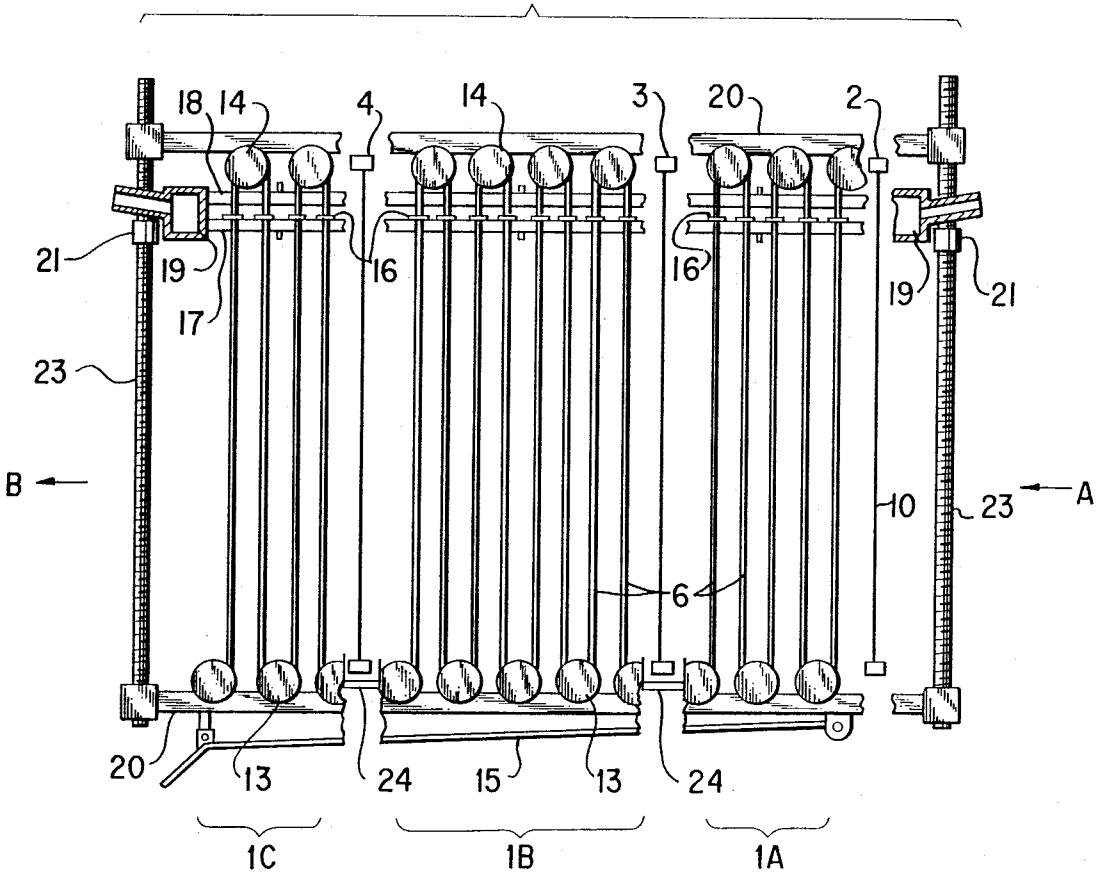
FIG. 2 is a side view of the apparatus in FIG. 1.

The heat exchanger itself includes, as illustrated in FIG. 2, a lower horizontal group of collection pipes 13, and an upper group of collection pipes 14 parallel thereto. Pipes 6 are in communication with the collection pipes in the manner illustrated, and these vertical pipes serve to capture deposits and as heat exchanger pipes. Electrically, they also serve as collector pipes through which an unillustrated fluid passes in counter flow to the flow of the heated gas for taking up the heat in it. It will be understood that a plurality of pipes 6 is arranged in a row along the length of a collection pipe, and it may thus be said that the pipes 6 are mutually connected in parallel, while rows of parallel-connected pipes are connected in series, with each other via the collection pipes 13, 14. The vertically upstanding pipes 6 thus form a rectangular grid. A collection trough 15 is disposed under the pipes.

A cleaning member 16 in the shape of a washer with its hole slightly chamfered on both sides encompasses each pipe 6. The washer can be moved along the length of the pipes 6, such as to provide effective scraping action on the coatings deposited on the pipes. The coatings form a film on which the washers glide without scratching the pipes 6, which are usually of copper. Washer shifting bars made from hollow sections are arranged in an upper 18 and lower 17 group between each row of parallel-connected pipes along the flow direction A-B. The bars have a width relative the intermediate spaces between the pipes 6 such as to nearly fill the spaces, the cleaning members 16 thus resting on the lower bars 17 when not in use. At their ends the bars are connected to collection members 19. The ends of the latter are mutually connected via a stiff, longitudinal bar 19*a* outside the grid of vertical pipes 6. The arrangement is defined and carried by a frame formed from horizontal upper and lower bars 20 with vertical side bars 20. To enable movement of the cleaning members 16 along the pipes 6, there are vertical screws 23 attached to the carrying frame in the manner illustrated in FIG. 1, while the frame formed from the bars 19*a* is provided with nuts 21. An electric motor 22 (FIG. 1) drives the vertical screws 23 via a schematically illustrated chain and chainwheel system. By activating the motor 22 and injecting steam, solvent or other cleaning agent into the collection members 19, the pipes 6 are relieved of pollutants that may have been deposited thereon and that may have a solid or sticky consistency. It will be understood that the motor 22 may be driven during the operation of the heat exchanger, signifying that the inventive apparatus does not need to be taken out of service for cleaning.

There are pipe lengths 24, extending between the lower collection pipes 13, for communication between the heat exchanger collector sections denoted by 1A, 1B, 1C in FIG. 2. As mentioned, the side walls are covered by plates, denoted by 25 in FIG. 1. These are fastened to the carrier frame 20, and guards 26 are placed round the screws 23 in the manner illustrated in FIG. 1. A steam hose 27 is connected to collection members 19. The cleaning means is connected to the nuts 21 with the aid of an unillustrated bracket fastened to the bar 19*a*. The bracket passes through and along a flange seal.

Figure 3:
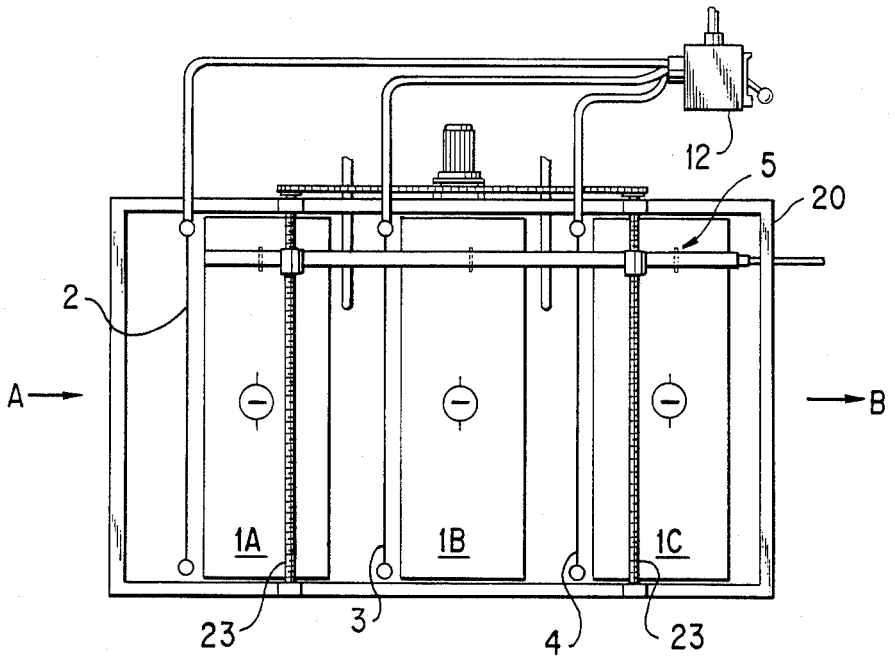
FIG. 3 is a schematic side view of the apparatus in FIG. 1.
Figure 4:
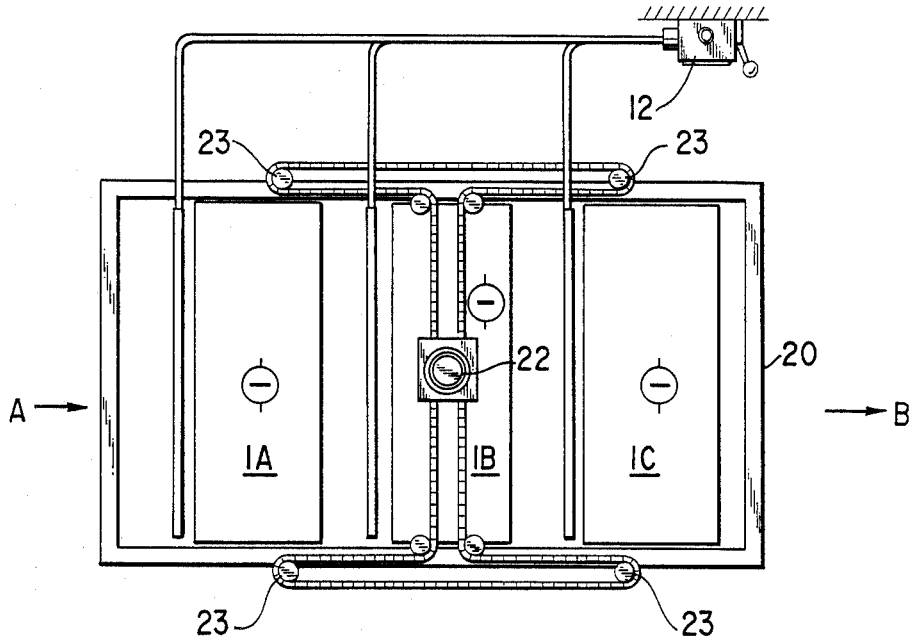
FIG. 4 is a schematic plan of the apparatus in FIG. 1.

The function of the apparatus will now be described in detail below with reference to FIGS. 3 and 4.

A gas flow containing particulate or gaseous pollutants, which are usually present in the form of an aerosol mist, enters at A and meets the first emission electrode means 2, where the gas is ionised, with subsequent charging of the particles. The latter are then captured by electrostatic attraction on the combined, cleanable, heat exchanger/collector surface 6. The gas flow is simultaneously cooled during its passage between the vertically upstanding pipes 6 in the heat exchanger section 1A, the pollutants in the gas phase condensing on the ions or electrically charged particles serving as condensation cores, a new aerosol mist being formed simultaneously as heat is recovered from the gas flow and the cooling medium on the other side of the heat exchanging interface is heated. The first heat exchange step 1A thus provides a collector surface for the pollutants, which were already in aerosol form on entry into the apparatus, and also as heat exchanger and generator of a new aerosol, which is then electrically charged and passed to the next section 1B.

The same process as described above is repeated in the heat exchanger section 1B, but now starting from a lower initial temperature and a lower pollutant content in the gas flow. The heat exchanging surfaces also serve here the double purpose mentioned above.

The described process is finally repeated in section 1C, but now starting from an even lower initial temperature and pollution of the twice-cleaned gas flow.

Since the dew point of the pollutants in the gas phase has been successively lowered, greater and greater amounts of the pollutants will be condensed out from the gas flow.

It will be understood that the heat exchanger/collector surfaces. i.e. the exterior surfaces of the pipes 6, can be cleaned during operation of the apparatus by activating the motor 22 and moving the cleaning members 16 up and down along the pipes. Exchanging frames or cartridges of emission electrodes can be performed readily and rapidly during operation of the apparatus, the high voltage naturally being interrupted first. In certain cases, automatic cleaning of the emission electrodes can be performed.

It may be sometimes suitable to reduce the water content of the gas flow before the cooling step, e.g. by drying.

Although the invention has been described above in connection with a special type of tube heat exchanger, it will be understood that other types thereof may be used, providing that the pipes are electrically conductive, such that the electrically charged particles fasten on the exterior of the pipes by electrostatic attraction as the gas flow passes along the air path of the heat exchanger.

The collector electrode/heat exchanger surface is usually earthed, while the emission electrode means is at a negative potential relative to earth.

I claim:

1. Method of simultaneously recovering heat and removing gaseous and sticky pollutants from a heated, polluted gas flow, said method being performed in a closed device, comprising the steps of (a) ionizing the gas flow by causing it to pass an emission electrode means (2), ions being formed and pollutant particles in the gas flow being charged, followed by (b) deposition of the pollutant particles charged on their passage through the emission electrode means, on a combined collector electrode/heat exchanger surface by electrostatic action, characterized by the following step performed simultaneously with the deposition, (c) generating an aerosol by cooling the gas flow during its passage through said combined collector electrode/heat exchanger surface, the pollutants in the gas phase condensing onto the ions and the electrically charged pollutant particles serving as condensation cores, simultaneously as heat is recovered from the gas flow.

2. Method as claimed in claim 1, characterized by repeating the steps (a)–(c), starting from a lower and lower initial temperature and a lower and lower pollutant content in the gas flow until the gas has been cleaned to a desired degree.

3. Apparatus for simultaneously recovering heat and removing gaseous and sticky pollutants from a heated, polluted gas flow, said apparatus including a heat exchanger (1) having a plurality of heat exchanger members (6) successively arranged in the gas flow direction, one surface of the members being swept over by the heated, polluted gas, the other surface thereof being swept over by a heat receiving medium, characterized by a plurality of emission electrode means (2–4) at mutual spacing in the gas flow direction between groups (1A, 1B, 1C) of heat exchanger members (6).

4. Apparatus as claimed in claim 3, the heat exchanger being of the counter flow type, and of the general type wherein said heat exchanger members include a plurality of pipes (6) arranged in a grid pattern, wherein the pipes in a row transverse the gas flow direction are connected together in parallel via collection pipes (13, 14) while each of the rows of parallel-connected pipes is connected in series with each other via the collection pipes (13, 14), characterized in that a first emission electrode means (2) is disposed at an inlet of the heat exchanger in front, as seen in the direction of the gas flow, of the first row of parallel-connected pipes (6), in that a second and a third emission electrode means (3 and 4) are disposed spaced from each other between groups (1A, 1B, 1C) of rows of the parallel-connected pipes at mutual spacing such that there are approximately just as many pipes in each group.

5. Apparatus as claimed in claim 4, characterized in that each emission electrode means is a corona discharge device which includes electrically conductive wires (10) stretched between two electrically insulated battens (8, 9) such that the wires run mutually parallel, and in that the entire aggregate of wires and battens is contained in a frame (7) such as to form a cassette.

6. Apparatus as claimed in claim 3, characterized in that each emission electrode means is a corona discharge device which includes electrically conductive wires (10) stretched between two electrically insulated battens (8, 9) such that the wires run mutually parallel, and in that the entire aggregate of wires and battens is contained in a frame (7) such as to form a cassette.

7. Apparatus as claimed in claim 6, characterized in that each cassette is removably attached to the heat exchanger and is provided with electrical connection devices (11).

8. Apparatus as claimed in claim 7, characterized by an automatic cleaning means for the emission electrode means.

* * * * *